US007128028B2

(12) United States Patent
Paul et al.

(10) Patent No.: US 7,128,028 B2
(45) Date of Patent: Oct. 31, 2006

(54) WATER-COOLED CYLINDER HEAD FOR A MULTICYLINDER INTERNAL-COMBUSTION ENGINE

(75) Inventors: Michael Paul, Weissach (DE); Frank Ickinger, Pleidelsheim (DE)

(73) Assignee: Dr. Ing. h.c.F. Porsche Aktiengesellschaft, Stuttgart (DE)

( * ) Notice: Subject to any disclaimer, the term of this patent is extended or adjusted under 35 U.S.C. 154(b) by 0 days.

(21) Appl. No.: 11/234,110

(22) Filed: Sep. 26, 2005

(65) Prior Publication Data

US 2006/0016404 A1 Jan. 26, 2006

Related U.S. Application Data

(63) Continuation of application No. PCT/EP2005/002724, filed on Mar. 15, 2005.

(30) Foreign Application Priority Data

Mar. 27, 2004 (DE) ..... 10 2004 015 135.0

(51) Int. Cl.
*F02F 1/36* (2006.01)
*F02B 23/00* (2006.01)

(52) U.S. Cl. ..... 123/41.82 R; 123/666

(58) Field of Classification Search ..... 123/41.82 R, 123/666
See application file for complete search history.

(56) References Cited

U.S. PATENT DOCUMENTS 2,188,876 A * 1/1940 Fahlman ..... 123/41.76
2,339,972 A * 1/1944 Anderson et al. ..... 123/41.82 R
4,889,079 A 12/1989 Takeda et al.
4,993,227 A * 2/1991 Nagura et al. ..... 123/41.82 R
5,094,193 A 3/1992 Yoshikawa
2002/0170510 A1* 11/2002 Iizuka et al. ..... 123/41.82 R

FOREIGN PATENT DOCUMENTS

| | | |
|---|---|---|
| DE | 199 55 431 A1 | 5/2001 |
| EP | 1 028 247 A2 | 8/2000 |
| JP | 62-20655 | 1/1987 |
| JP | 11-336608 | 12/1999 |
| JP | 2001 116069 A | 4/2001 |

* cited by examiner

*Primary Examiner*—Noah P. Kamen
(74) *Attorney, Agent, or Firm*—Crowell & Moring LLP

(57) ABSTRACT

A water-cooled cylinder head for a multicylinder internal-combustion engine, has a cylinder head housing which has charge cycle ducts, passage bores for receiving cylinder head screws, valve stem guides for inlet and outlet valves controlling the charge cycle ducts, and part-spherical combustion chamber caps which are bounded by a water cooling jacket on a side facing away from the combustion chamber. One spark plug dome respectively has an opening leading to the combustion chamber of the respective cylinder. For reinforcing the cylinder head housing and/or for supporting the part-spherical combustion chamber caps, a rib structure is integrated in the cylinder head housing.

16 Claims, 3 Drawing Sheets

WATER-COOLED CYLINDER HEAD FOR A MULTICYLINDER INTERNAL-COMBUSTION ENGINE

This application is a continuation of International Patent Application No. PCT/EP2005/002724 filed on Mar. 15, 2005, designating the United States of America, the entire disclosure of which is incorporated herein by reference. Priority is claimed based on German Patent Application No. DE 10 2004 015 135.0 filed Mar. 27, 2004.

BACKGROUND AND SUMMARY OF THE INVENTION

Preferred embodiments of the invention relate to a water-cooled cylinder head for a multicylinder internal-combustion engine having a cylinder head housing comprising charge cycle ducts, passage bores for receiving cylinder head screws, valve stem guides for inlet and outlet valves, part-spherical combustion chamber caps which are bounded by a water cooling jacket on a side facing away from a respective combustion chamber, and one spark plug dome respectively whose opening leads to the combustion chamber of the respective cylinder.

A water-cooled cylinder head of the above-mentioned type is known, for example, from German Patent Document DE 199 55 431 A1.

In the case of motor vehicles, it is generally endeavored to reduce the overall weight of the vehicle, among other things, for saving fuel. For this purpose, light-metal alloys are increasingly used, for example, for the crankcase and cylinder head housing for engines. However, particularly in the case of high-performance engines, temperature peaks occur because of the high specific performance in the cylinder head, particularly in the area between the outlet valves or between the outlet valve and the spark plug. This results in temperature stress in the material and, in connection with external loads, may lead to permanent deformations in the seat ring area and thus to valve leakiness.

It is therefore an object of the invention to overcome the above-mentioned disadvantages.

This object is achieved by providing water-cooled cylinder head for a multicylinder internal-combustion engine, having a cylinder head housing comprising charge cycle ducts, passage bores for receiving cylinder head screws, valve stem guides for inlet and outlet valves, part-spherical combustion chamber caps which are bounded by a water cooling jacket on a side facing away from a respective combustion chamber, and one spark plug dome respectively whose opening leads to the combustion chamber of the respective cylinder, wherein, for reinforcing the cylinder head housing and/or for supporting the part-spherical combustion chamber caps, a rib structure is integrated in the cylinder head housing.

As a result of the fact that a rib structure is integrated in the cylinder head housing, the cylinder head housing constructed of light metal can be reinforced and the highly temperature-stressed part-spherical combustion chamber caps can be effectively anchored in the cylinder head housing. By means of these structural measures, it is ensured that, despite a high temperature stress, the cylinder head remains dimensionally stable, particularly in the area of the part-spherical combustion chamber caps.

Additional characteristics further developing the invention are indicated herein and in the claims.

According to certain preferred embodiments of the invention, for the optimal support or structural reinforcement of the part-spherical combustion chamber caps, the rib structure has a longitudinal rib penetrating the water cooling jacket.

According to certain preferred embodiments of the invention, so that, despite the longitudinal rib penetrating the water cooling jacket, an unhindered coolant flow can take place from the valve outlet side to the valve inlet side, corresponding passage openings are constructed in the longitudinal rib.

According to certain preferred embodiments of the invention, a particularly effective support or suspension of the part-spherical combustion chamber caps is ensured when the longitudinal rib is provided centrally between the valve inlet side and the valve outlet wide and is linked to the individual spark plug domes.

According to certain preferred embodiments of the invention, for the further reinforcement of the cylinder head housing, the rib structure has diagonal ribs which are linked to the domes for the cylinder head screws, the spark plug domes as well as the valve stem guides.

A particularly effective rib structure is obtained according to certain preferred embodiments of the invention, when, in addition to the longitudinal and diagonal ribs, transverse ribs are provided which mutually connect the domes for the cylinder head screws, which domes are placed in the cylinder head housing on the inlet side and the outlet side.

The drawing illustrates an embodiment of the invention which will be described in detail in the following.

Other objects, advantages and novel features of the present invention will become apparent from the following detailed description of the invention when considered in conjunction with the accompanying drawings.

DETAILED DESCRIPTION OF THE DRAWINGS

Figure 1:
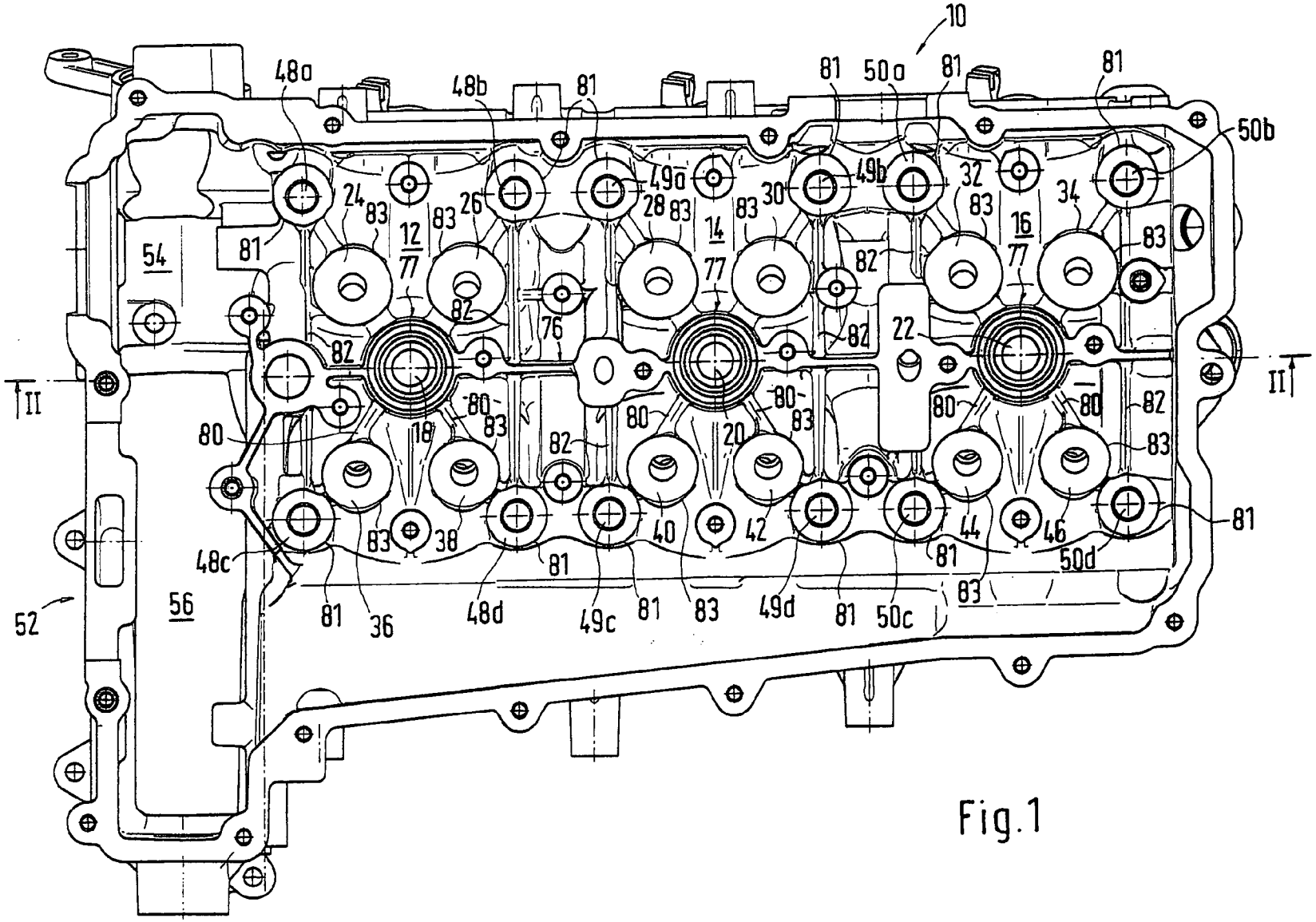
FIG. 1 is a top view of a cylinder head housing.

The cylinder head housing 10 illustrated in FIG. 1 has three cylinder head sections 12, 14, 16 which have screw-in openings 18, 20, 22 for spark plugs in their central area. Above the screw-in openings 18, 20, 22, two valve stem guides 24, 26 and 28, 30 and 32, 34 respectively for the inlet valves are in each case illustrated for each cylinder. Corresponding valve stem guides 36, 38 and 40, 42 and 44, 46 respectively for the outlet valves are provided below the screw-in openings 18, 20, 22.

The screwing of the cylinder head housing 10 to the crankcase takes place by means of four cylinder head screws for each cylinder. For this purpose, four passage bores 48*a* to 48*d* and 49*a* to 49*d* and 50*a* to 50*d* respectively are provided in the cylinder head housing 10 for each cylinder head section 12, 14, 16. A chain case 52 is constructed on the face of the cylinder head housing 10, which chain case 52 receives a chain pinion for the drive of the inlet camshaft in an upper section 54, which chain pinion is not shown. In a lower section 56 of the chain case 52, the driving pinion for the outlet camshaft is arranged.

Figure 3:
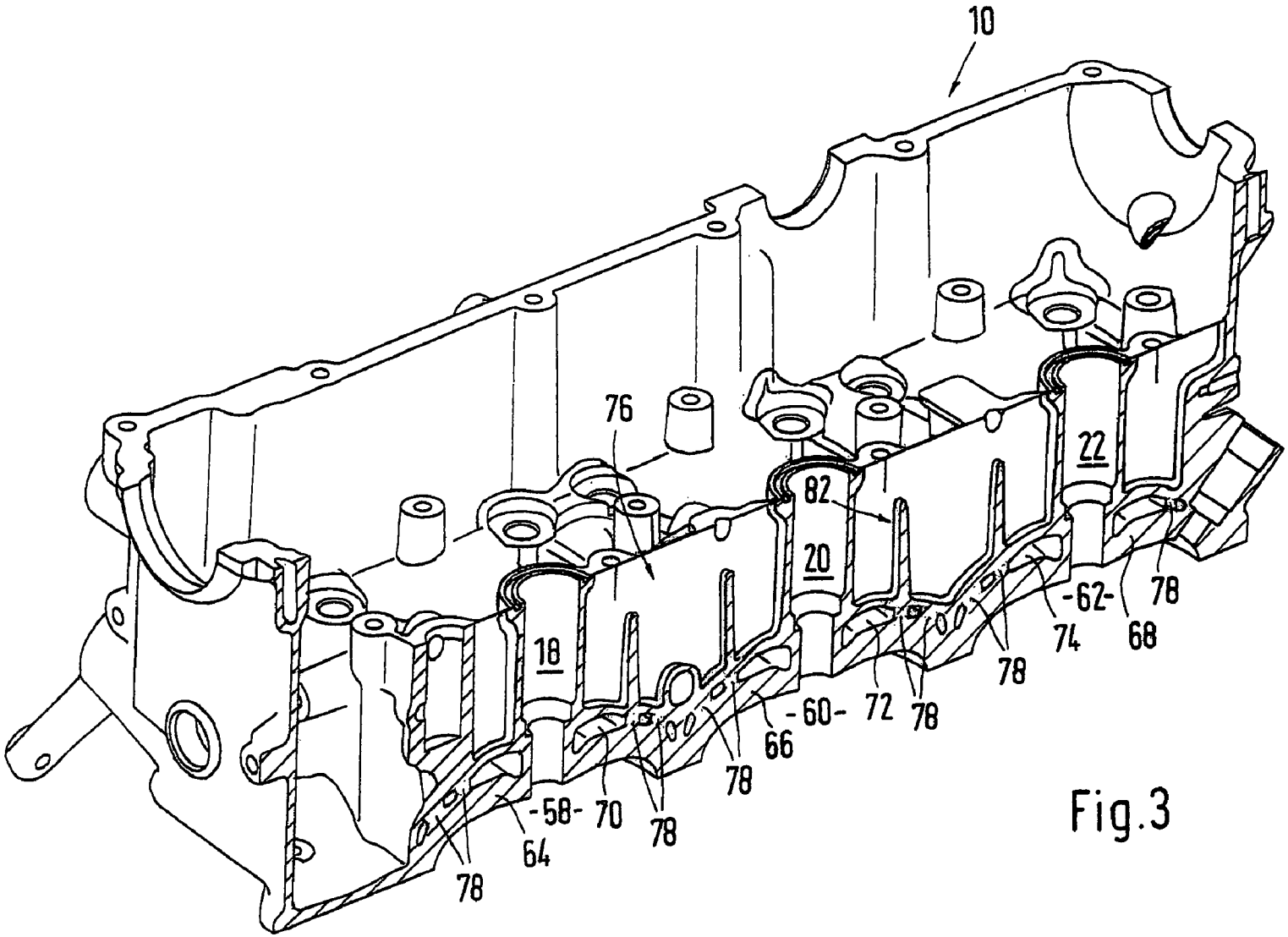
FIG. 3 is a perspective view of the cylinder head cut open along the Line II—II.

As illustrated in FIG. 3, corresponding combustion chamber troughs 58, 60, 62 are constructed in the cylinder head housing 10, which combustion chamber troughs 58, 60, 62 are bounded by the so-called part-spherical combustion chamber caps 64, 66, 68. Above the part-spherical combustion chamber caps 64, 66, 68, water cooling jackets 70, 72, 74 are constructed, cooling water flowing transversely—from the valve outlet side to the valve inlet side—through the water cooling jackets 70, 72, 74 during the operation of the internal-combustion engine.

In the cylinder head housing 10, a rib structure is provided for reinforcing the cylinder head housing 10 and for supporting the part-spherical combustion chamber caps 64, 66, 68 which will be described in detail in the following.

Figure 2:
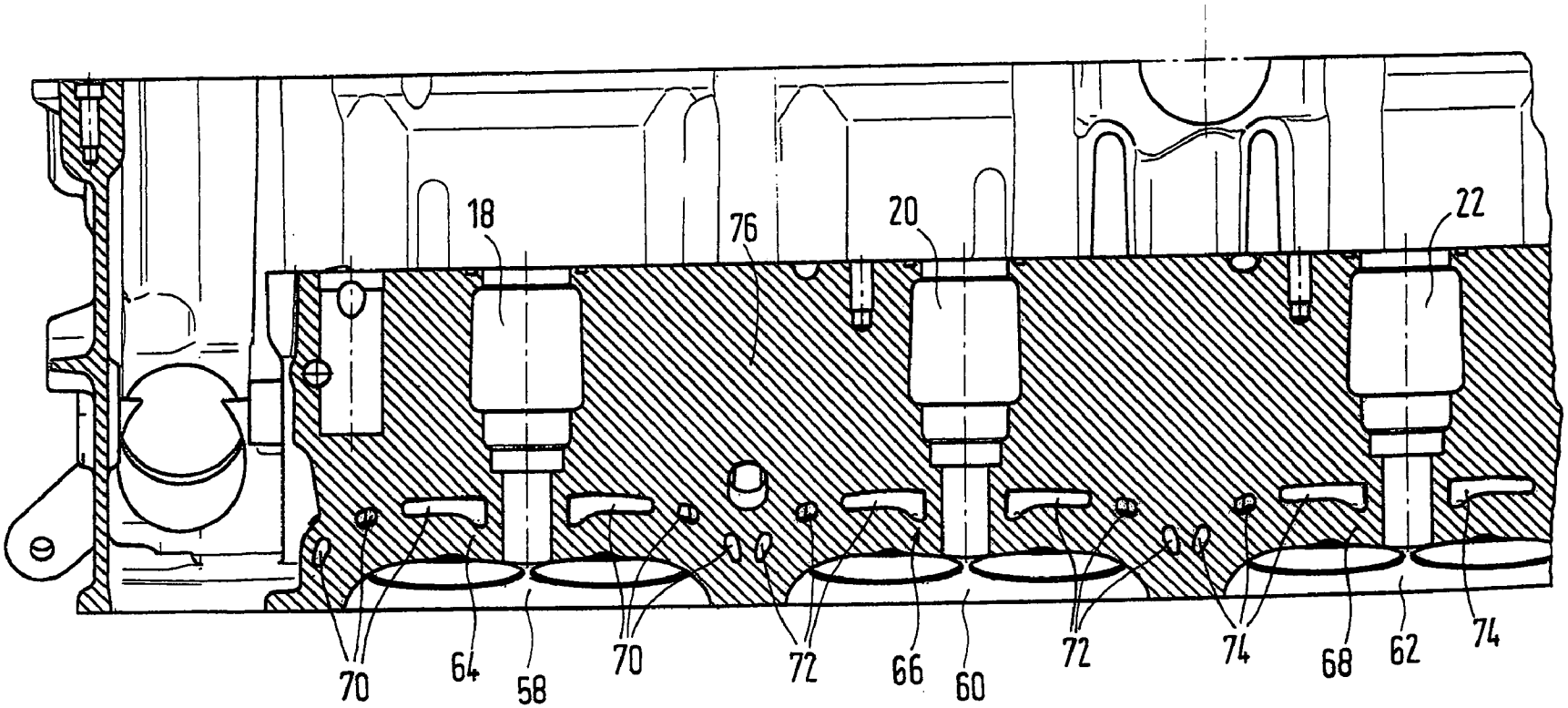
FIG. 2 is a longitudinal sectional view of the cylinder head housing according to Line II—II in FIG. 1.

Along the intersection line II—II shown in FIG. 1, a longitudinal rib 76 is provided which extends along the three cylinder head sections 12, 14, 16 and which, as illustrated in FIGS. 2 and 3, is linked to the domes 77 of the screw-in openings 18, 20, 22 for the spark plugs. The longitudinal rib extends in the direction of the water cooling jacket 70, 72, 74 and cast to the part-spherical combustion chamber caps 64, 66, 68 by way of ribs or webs 78 penetrating the water cooling jacket 64, 66, 68. This achieves, on the one hand, a reinforcement of the cylinder head housing 10 and, on the other hand, a support or a secure suspension of the part-spherical combustion chamber caps 64, 66, 68.

As further illustrated in FIG. 1, in addition to the longitudinal rib 76, diagonal ribs 80 are provided for the further reinforcement of the cylinder head housing 10, which diagonal ribs 80 are linked or cast to the domes 81 for the cylinder head screws, the valve stem guides 83 as well as the spark plug domes 77. In addition, for each cylinder head section 12, 14, 16, the rib structure has two—relative to the longitudinal cylinder head axis (see Line II—II)—transverse ribs 82, which are in each case cast to the domes 81 for the screwed cylinder head connections. Furthermore, the webs 78 penetrating the water cooling jacket 70, 72, 74 are oriented such that, as guiding ribs, they guide a portion of the cooling water in a targeted manner into the area of the spark plug dome 77.

The foregoing disclosure has been set forth merely to illustrate the invention and is not intended to be limiting. Since modifications of the disclosed embodiments incorporating the spirit and substance of the invention may occur to persons skilled in the art, the invention should be construed to include everything within the scope of the appended claims and equivalents thereof.

What is claimed is:

1. Water-cooled cylinder head for a multicylinder internal-combustion engine, having a cylinder head housing comprising:

charge cycle ducts, passage bores for receiving cylinder head screws, valve stem guides for inlet and outlet valves, spherical combustion chamber caps which are bounded by a water cooling jacket on a side facing away from a respective combustion chamber, and one spark plug dome respectively whose opening leads to the combustion chamber of the respective cylinder, wherein, for reinforcing the cylinder head housing and for supporting the spherical combustion chamber caps, a rib structure is integrated in the cylinder head housing, and wherein the rib structure has a longitudinal rib penetrating the water cooling jacket, on which longitudinal rib the spherical combustion chamber caps of the individual cylinder head sections are supported.

2. Water-cooled cylinder head according to claim 1, wherein the longitudinal rib has ribs or webs in the area of the water cooling jacket for constructing passage openings for the cooling water.

3. Water-cooled cylinder head according to claim 2, wherein the longitudinal rib is provided between the valve inlet and outlet side and is cast to the individual spark plug domes.

4. Water-cooled cylinder head according to claim 3, wherein the rib structure also has diagonal ribs which are cast onto the domes for the cylinder head screws, the domes for the valve stem guides as well as the spark plug domes.

5. Water-cooled cylinder head according to claim 3, wherein the rib structure also has transverse ribs which are cast to the domes for the cylinder head screws.

6. Water-cooled cylinder head according to claim 2, wherein the rib structure also has diagonal ribs which are cast onto the domes for the cylinder head screws, the domes for the valve stem guides as well as the spark plug domes.

7. Water-cooled cylinder head according to claim 2, wherein the rib structure also has transverse ribs which are cast to the domes for the cylinder head screws.

8. Water-cooled cylinder head according to claim 1, wherein the longitudinal rib is provided between the valve inlet and outlet side and is cast to the individual spark plug domes.

9. Water-cooled cylinder head according to claim 8, wherein the rib structure also has diagonal ribs which are cast onto the domes for the cylinder head screws, the domes for the valve stem guides as well as the spark plug domes.

10. Water-cooled cylinder head according to claim 8, wherein the rib structure also has transverse ribs which are cast to the domes for the cylinder head screws.

11. Water-cooled cylinder head according to claim 1, wherein the rib structure also has diagonal ribs which are cast onto the domes for the cylinder head screws, the domes for the valve stem guides as well as the spark plug domes.

12. Water-cooled cylinder head according to claim 11, wherein the rib structure also has transverse ribs which are cast to the domes for the cylinder head screws.

13. Water-cooled cylinder head according to claim 1, wherein the rib structure also has transverse ribs which are cast to the domes for the cylinder head screws.

14. Water-cooled cylinder head according to claim 1, wherein said cylinder head housing is constructed of light metal alloy.

15. A cast cylinder head housing for a multicylinder internal combustion engine, comprising:

a plurality of part-spherical combustion chamber caps for a like plurality of engine combustion chambers, a rib structure cast into the cylinder head housing for reinforcing the cylinder head housing and supporting the part-spherical combustion chamber caps, and a water cooling jacket bounding the part-spherical combustion chamber caps, wherein the rib structure has a longitudinal rib penetrating the water cooling jacket, on which longitudinal rib the part-spherical combustion chamber caps of the individual cylinder head sections are supported.

16. A cylinder head housing according to claim 15, comprising domes for cylinder head fastening screws, domes for valve stem guides, and spark plug domes, wherein the rib structure has diagonal ribs which are cast onto the domes for the cylinder head screws, the domes for the valve stem guides as well as the spark plug domes.

* * * * *